US006772666B2

(12) United States Patent
Heil et al.

(10) Patent No.: US 6,772,666 B2
(45) Date of Patent: Aug. 10, 2004

(54) BAG STAND

(75) Inventors: Ross F. Heil, Pleasant Hill, CA (US); Ernest A. Lopez, Fresno, CA (US)

(73) Assignee: Tilia International, Inc., San Francisco, CA (US)

( * ) Notice: Subject to any disclaimer, the term of this patent is extended or adjusted under 35 U.S.C. 154(b) by 0 days.

(21) Appl. No.: 10/040,003

(22) Filed: Nov. 7, 2001

(65) Prior Publication Data

US 2003/0084649 A1 May 8, 2003

(51) Int. Cl.[7] ..... B26D 1/04

(52) U.S. Cl. ..... 83/614; 83/485; 83/650; 83/949

(58) Field of Search ..... 23/167, 485, 487, 23/614, 650, 949, 483, 489, 955; 53/512, 570; 225/7, 23, 25, 31, 34, 36, 39, 47, 52, 53, 54, 77, 89

(56) References Cited

U.S. PATENT DOCUMENTS 172,634 A * 1/1876 Lachman ..... 242/524.1
760,800 A * 5/1904 Nice ..... 83/455
3,496,817 A * 2/1970 Staats et al. ..... 83/56
3,524,373 A * 8/1970 Helmus, Jr. ..... 83/522.21
3,821,915 A * 7/1974 Larrable ..... 83/174
4,754,674 A * 7/1988 Perlman ..... 83/422
4,762,042 A * 8/1988 Denter et al. ..... 83/374
5,044,241 A * 9/1991 Labrecque ..... 83/489
5,103,710 A * 4/1992 Ross ..... 83/485
5,894,978 A * 4/1999 Welch et al. ..... 225/7

* cited by examiner

*Primary Examiner*—Boyer D. Ashley
(74) *Attorney, Agent, or Firm*—Fliesler Meyer LLP

(57) ABSTRACT

The present invention is an apparatus for storing rolls of material so that a user can create individual bags from the rolls. For example, the device may store vacuum bag material suitable for filling with food and vacuum sealing. The apparatus has a support platform, a storage unit and a base for transporting two rolls of material simultaneously to the front of the apparatus. The storage unit has two rollers for storing up to two rolls. The apparatus also has a cutting mechanism for creating straight edges.

15 Claims, 6 Drawing Sheets

BAG STAND

FIELD OF THE INVENTION

The present invention relates generally to an apparatus for storing rolls of material so that, along with another device, a user can create individual sheets or bags for any other purpose from the roll. More particularly, the present invention allows a user, along with another device, to conveniently create individual vacuum bags that can be subsequently filled with food and sealed by a vacuum food packaging system.

BACKGROUND OF THE INVENTION

Various systems and methods are known for the purpose of vacuum sealing plastic bags to protect perishables therein against oxidation. As oxygen is a main cause of food spoilage, removing the air that surrounds food stuff inhibits growth of bacteria, mold and yeast. In this regard, vacuum sealed foods often last three to five times longer than normal refrigerated food stored in ordinary plastic bags. Moreover, vacuum sealing is useful for storing all kinds of items such as clothes, photographs or silver in order to prevent discoloration, corroding, rust and tarnishing. Vacuum sealing also results in tight, strong and compact packages thereby reducing the bulk of supplies and allowing for more space to store food or other articles. Furthermore, vacuum sealing minimizes odors which may spread to other stored items, and also acts to prevent freezer burn.

Typically, the vacuum sealing device and the vacuum bags, or a roll of vacuum bag material, are not located near each other. Often, the vacuum sealing device does not have any place to store the vacuum bags or a roll of material. Thus, an individual must store the vacuum bags and/or roll of material in a separate drawer or cabinet, or on the counter near the vacuum sealing device. Every time an individual wishes to vacuum seal food, clothes, silver, etc. the individual must first go to the separate drawer or cabinet and retrieve a vacuum bag or roll of material. After filling the bag, the individual must then go to the vacuum sealing machine to vacuum seal the bag. Not only is it inconvenient to store the bags or the roll of material separate from the vacuum sealing device, but a separate bag or roll of material also takes up extra space on the counter, or in a drawer or cabinet.

Some vacuum sealing devices currently for sale do include a storage unit capable of storing a roll of vacuum bag material. However, these vacuum sealing devices can only store one roll of vacuum bag material. There are several different sizes of rolls of vacuum bag material. Similarly, objects to be vacuum sealed within a vacuum bag can vary greatly in size. To form a vacuum seal within a bag, substantially all of the air must be drawn out of the bag. To minimize the amount of time required to draw the air out of the bag, an individual should choose a vacuum bag that the object can fit within, leaving as little remaining space as possible. By way of example only, vacuum sealing a single steak will require a smaller bag than vacuum sealing four or five steaks together in one bag. Thus, the individual will have to change-out the roll of vacuum bag material every time the roll in the vacuum sealing device is not the right size (e.g., from a small roll to a large roll, and vice versa). While one roll remains in the vacuum sealing device, the other roll(s) must be stored in a separate area. Therefore, a vacuum sealing device with a storage unit that can only store one roll of vacuum bag material does not provide a substantial improvement in convenience over a vacuum sealing device with no storage unit at all.

To seal a vacuum bag, many of the vacuum sealing systems have a substantially rectangular, thin slot where the opening of the bag must be placed within. For example, an apparatus for vacuum sealing plastic bags is described in U.S. Pat. No. 4,941,310 issued to Kristen. Sealing a first end of the bag requires a user to place the edge of the bag across a thin wire to heat seal the bag closed.

Many vacuum sealing devices do not have a tool for cutting a roll of vacuum bag material into individual sheets. Typically, an individual will cut the roll of vacuum bag material by hand to create an individual sheet. For example, the individual will cut the roll of vacuum bag material with scissors. It is extremely difficult to cut a roll of vacuum bag material with a pair of scissors and produce an individual sheet having ends with straight edges. Cutting the material by hand most often creates an uneven edge.

Before filling the bag with the food, one end must be sealed. Thus, an uneven rigid edge is placed across the heat sealable wire to create a first end. The wire is a very thin strip of metal. The metal wire heats up and melts the two layers of the bag together. If the edge is uneven, it is easy for some portion of the edge to not completely cover the heat sealable wire, and thus a proper seal between the layers will not form. Often, an individual must attempt to seal the sheet several times to achieve a proper seal. Therefore, it would be beneficial to have an apparatus that creates individual sheets with a straight edge on both ends.

SUMMARY OF THE INVENTION

One object of the present invention is to provide a device that is easy to load with bag creating material and put into operation. The device will complement an existing vacuum sealing apparatus that cannot create individual bags from a sheet of vacuum bag material. A user can quickly load the device, place their vacuum sealing system upon the device and begin to create and seal individual bags.

Another object of the present invention is to minimize the counter and/or cabinet and drawer space required to store a vacuum sealing apparatus and the roll(s) of vacuum bag material. An embodiment of the present invention saves counter and/or cabinet or drawer space by incorporating a storage unit and a cutting device within a vacuum sealing apparatus support structure, whereby the footprint is substantially the same size as the vacuum sealing apparatus.

Yet another object of the present invention is to support a vacuum sealing apparatus with no storage capability adjacent to a storage unit, and create individual sheets of vacuum bag material from which bags can be formed. An embodiment of the present invention has a substantially flat support structure attached with a vertically oriented storage unit.

Another object of the present invention is to provide a storage unit that can store up to two rolls of vacuum bag material. An embodiment of the present invention has two rollers that can accommodate several different sizes of rolls. In a preferred embodiment, each roll of vacuum bag material will self-align on the rollers in the storage unit.

Another aspect of the present invention allows the user to conveniently and repeatedly create individual sheets of vacuum bag material from which bags can be formed. In an embodiment, the present invention has a slidable cutting mechanism to create straight edges on both ends of the bag, making it easier for the vacuum sealing machine to heat seal the sheet.

Still another aspect of the present invention allows a user to access both rolls of vacuum bag material simultaneously.

An embodiment of the present invention has a base with an outlet near the front end. Preferably, the two sheets of material exit the base at different heights, allowing an individual to easily access either sheet.

Yet another aspect of the present invention is to provide a device that functions with any roll of material. By way of example only, a roll of paper non-vacuum plastic sheets may be stored in the device.

BRIEF DESCRIPTION OF THE DRAWINGS

Other objects and advantages of this invention will become apparent from the following description and accompanying drawings wherein.

DETAILED DESCRIPTION OF THE INVENTION

Figure 1:
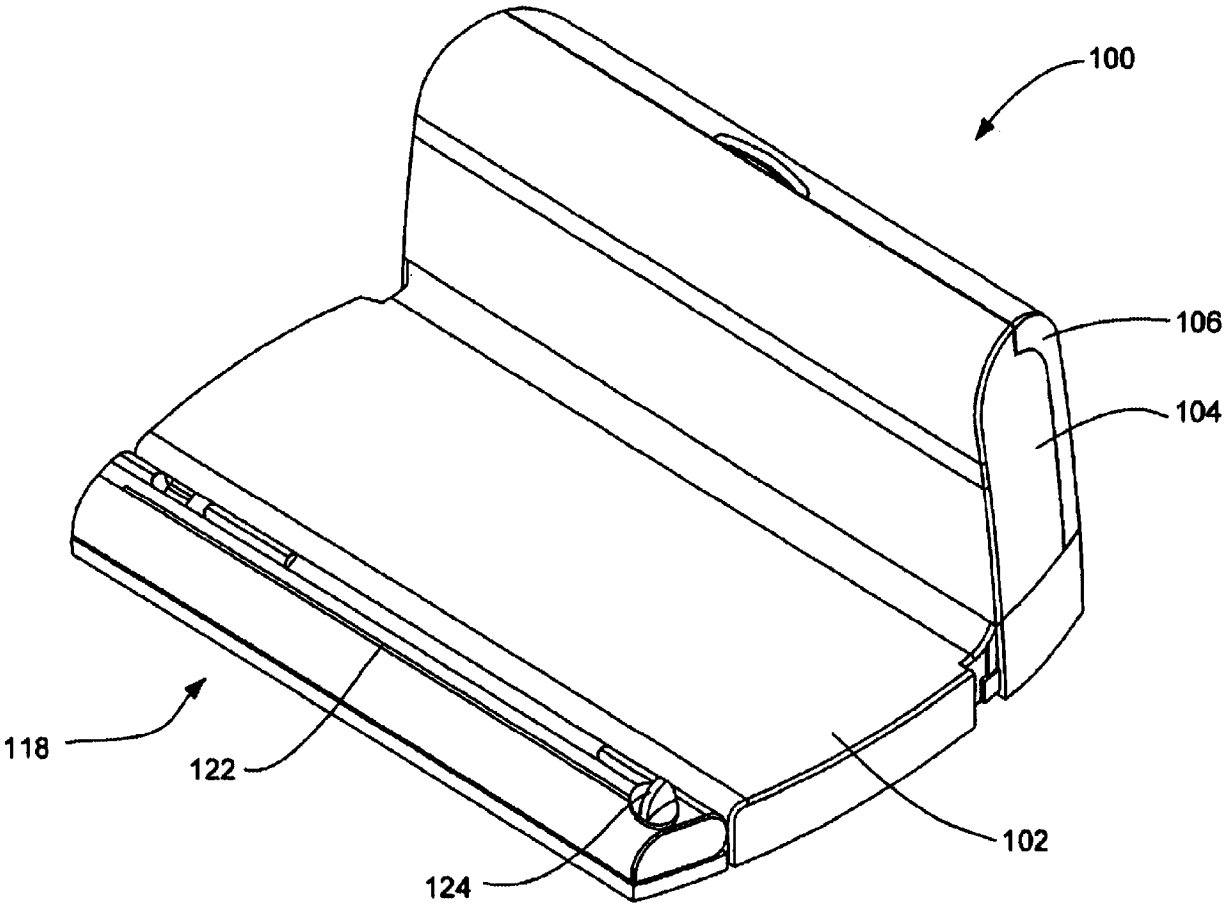
FIG. 1 is a perspective view of an embodiment of the present invention.
Figure 2:
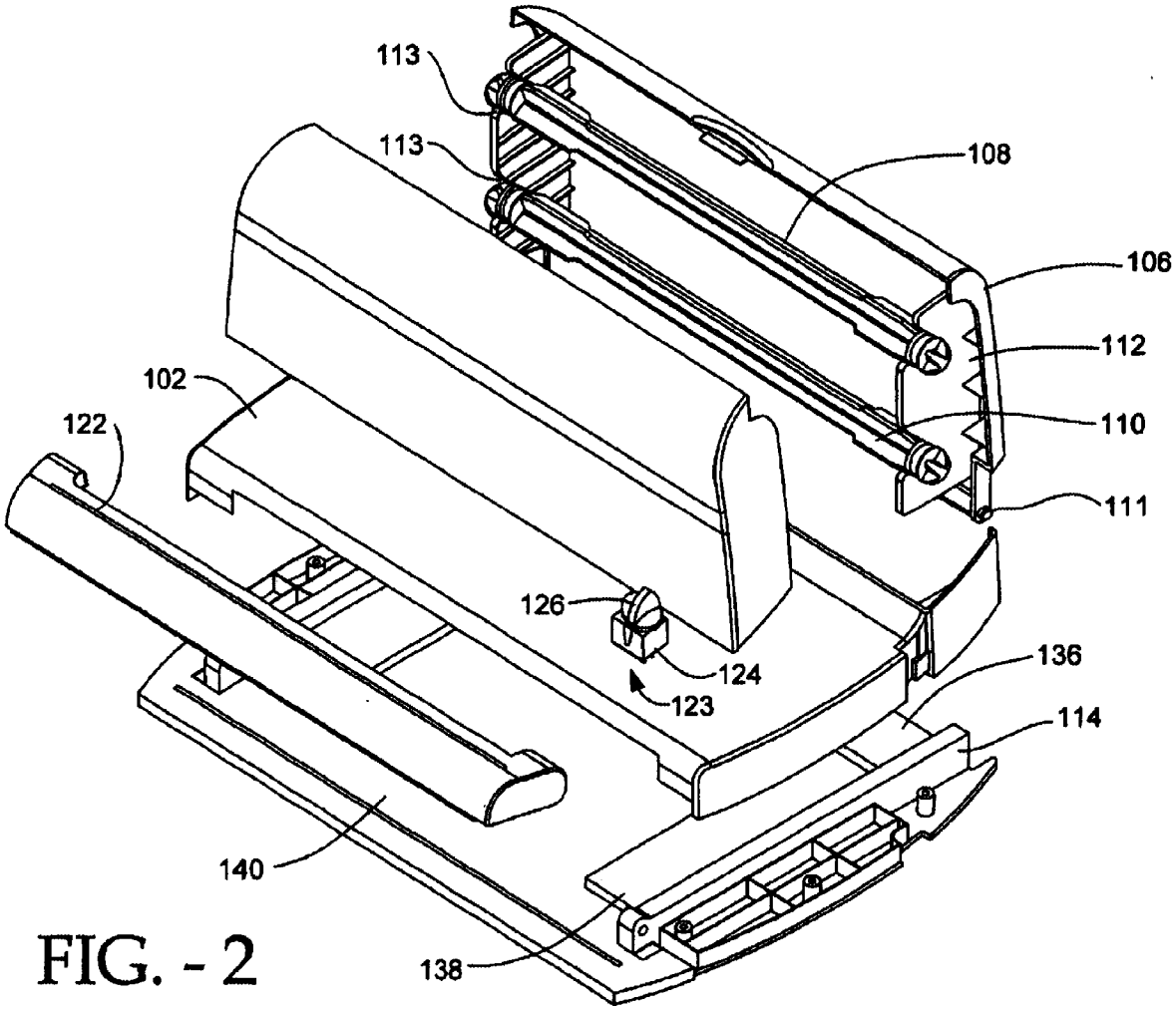
FIG. 2 is an assembly drawing illustrating the individual components of an embodiment of the present invention.

As shown in FIGS. 1 and 2, the bag has a platform 102. The platform 102 can support, for example, a vacuum packaging system. Byway of example only, a vacuum packaging system such as a Foodsaver® System by Tilia® may be placed onto the platform 102. The platform 102 is substantially horizontal so that the vacuum packaging system will remain stationary when placed upon the platform 102. Even though the description hereinafter relates to vacuum packaging systems and material, the bag stand 100 may also be used with systems and material that are not vacuum related (e.g., paper and non-vacuum plastic).

A storage unit 104 is attached to the rear of the platform 102. The storage unit 104 can hold up to two rolls of vacuum bag material. To minimize the footprint of the bag stand, the storage unit 104 is vertically oriented. A rear cover 106 opens to provide access to a first roller 108 and a second roller 110. As shown in FIG. 2, the first roller 108 and second roller 110 are vertically concentric. The cover 106 has two pins 111 engaging the platform 102 so that the cover 106 pivots about the axis of each pin 111. The rear cover 106 has two side supports 112 extending away from the rear cover 106 for retaining the first and second rollers 108,110. Each side support 112 has two "U" shaped notches 113. Each pair of "U" shaped notches 113 are aligned so that when the rollers 108, 110 nest within the "U" shaped notches 113, the roller is horizontal. The notches 113 are angled down toward the bottom of the rear cover 106 so that the first and second rollers 108, 110 are gravitationally held within the notches 113. By way of example only, each notch 113 is angled downward at a 45° angle. The first and second rollers 108, 110 preferably rotate freely within the "U"-shaped notches 113 so that an individual can easily remove the vacuum bag material from the front of the bag stand 100.

Figure 3:
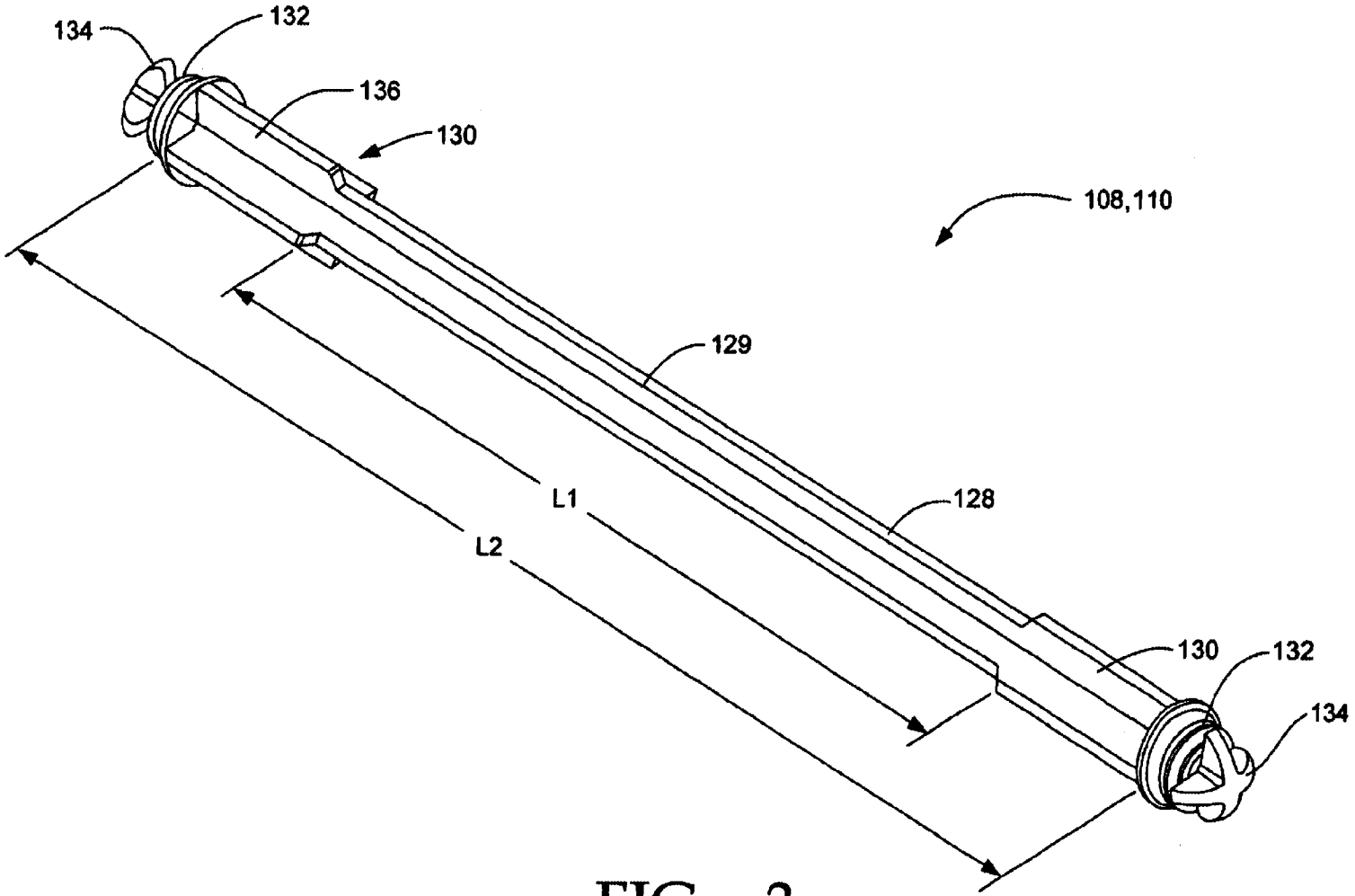
FIG. 3 is a perspective view of a roller for storing vacuum bag material.
Figure 4:
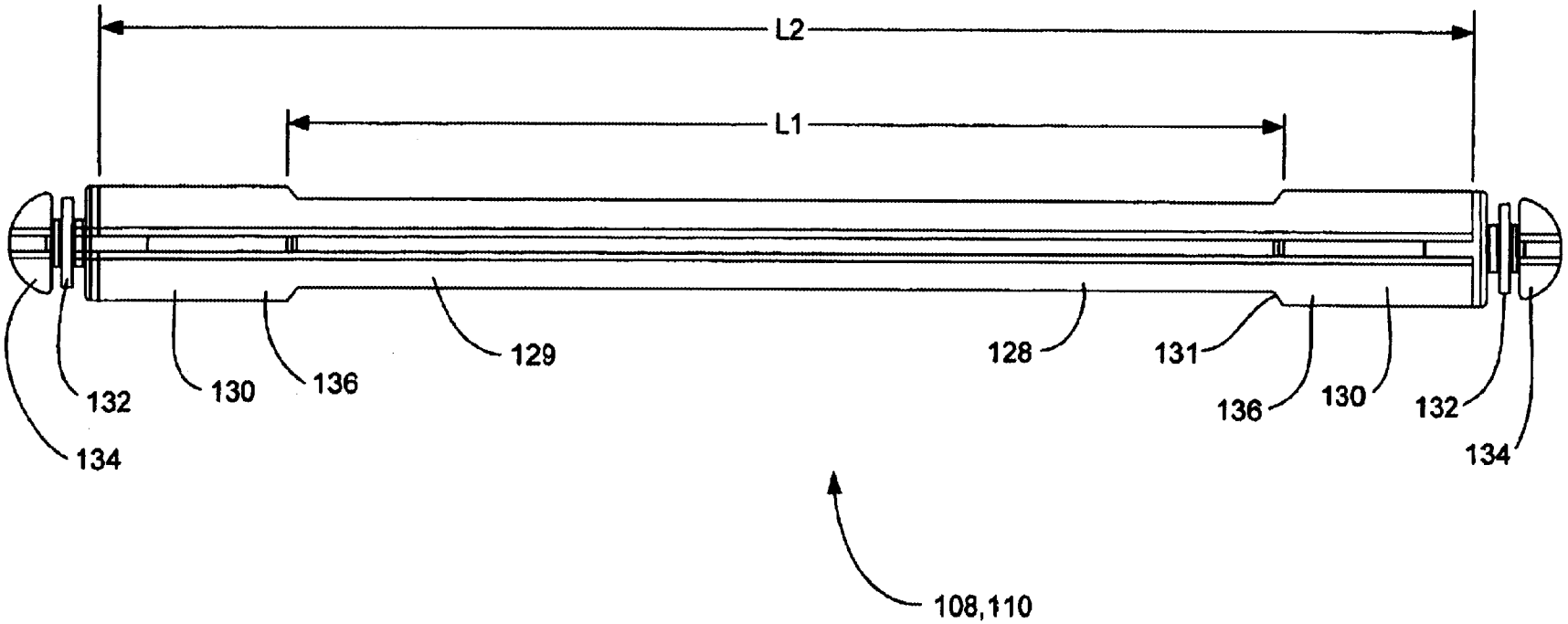
FIG. 4 is a side view of the roller illustrated in FIG. 3.

FIGS. 3 and 4 illustrate the features of the first and second rollers 108, 110. Since the first and second rollers 108, 110 are similar in design and function, only the first roller 108 will be referenced when describing each roller. However, the description of the first roller 108 also applies to the second roller 110.

Rolls of vacuum bag material are typically packaged into a small roll or a large roll. The first roller 108 can accommodate either a small roll or a large roll of vacuum bag material. The first roller 108 has a central shaft 128, including a center portion 129 and two ends 130. The ends 130 have a larger diameter than the center portion 129. The ends 130 taper gradually to match the smaller diameter of the center portion 129. The length of the shaft 128, L2, is preferably equal to the width of a large roll of vacuum bag material. By way of example only, the distance L2 is approximately 11". The center portion 129 is preferably the width of a small bag of vacuum bag material, indicated by the distance L1. By way of example only, the distance L1 is approximately 8". A roll of vacuum bag material may not be wider than L2, yet rolls of various widths smaller than L2 maybe placed upon the first roller 108. To minimize the weight of the first roller 108, the first roller is not of solid shape. Instead, the first roller 108 has fins 136. By way of example only, the first roller 108 has four fins 136. The diameter of the first roller 108 is substantially equal to the innermost diameter of a large roll at the ends 130, and is similar to the innermost diameter of a small roll along the center portion 129. It is within the scope of the present invention for the first roller 108 to have more or fewer fins 136.

When a small roll of vacuum bag material is placed onto the first roller 108, the small roll will fit entirely onto the center portion 129. The small roll will self align in the center of the first roller 108 because the outer edges of the small roll will rest on the tapered surface 131 (see FIG. 4). When a large roll of vacuum bag material is placed onto the shaft 128 the large roll will cover substantially the entire width L2 of the first roller 108. After placing a small or large roll of vacuum bag material onto the first roller 108, the roller 108 may be placed into the notches 113. The roller 108 has two handles 134 so that an individual can grasp the roller 108 after a roll of vacuum bag material is placed upon the roller. When the first roller 108 is placed into the notches 113, the handles 134 remain outside of the side supports 112 (see FIG. 2).

As previously mentioned, the first roller 108 preferably rotates freely within the notches 113, allowing a user to easily remove the vacuum bag material from the front end of the base 114. The first roller 108 has two bearings 132 to engage the notches 113. Each bearing 132 is located along the roller so that they will engage the notches 113 when the roller is resting within the storage unit 104. The bearings 132 are substantially the same width as the side supports 112 so that each bearing 132 nests within the notch 113. The bearings 132 rotate independently of the first roller 108 allowing the roller to rotate freely when placed in the storage unit 104.

Figure 5:
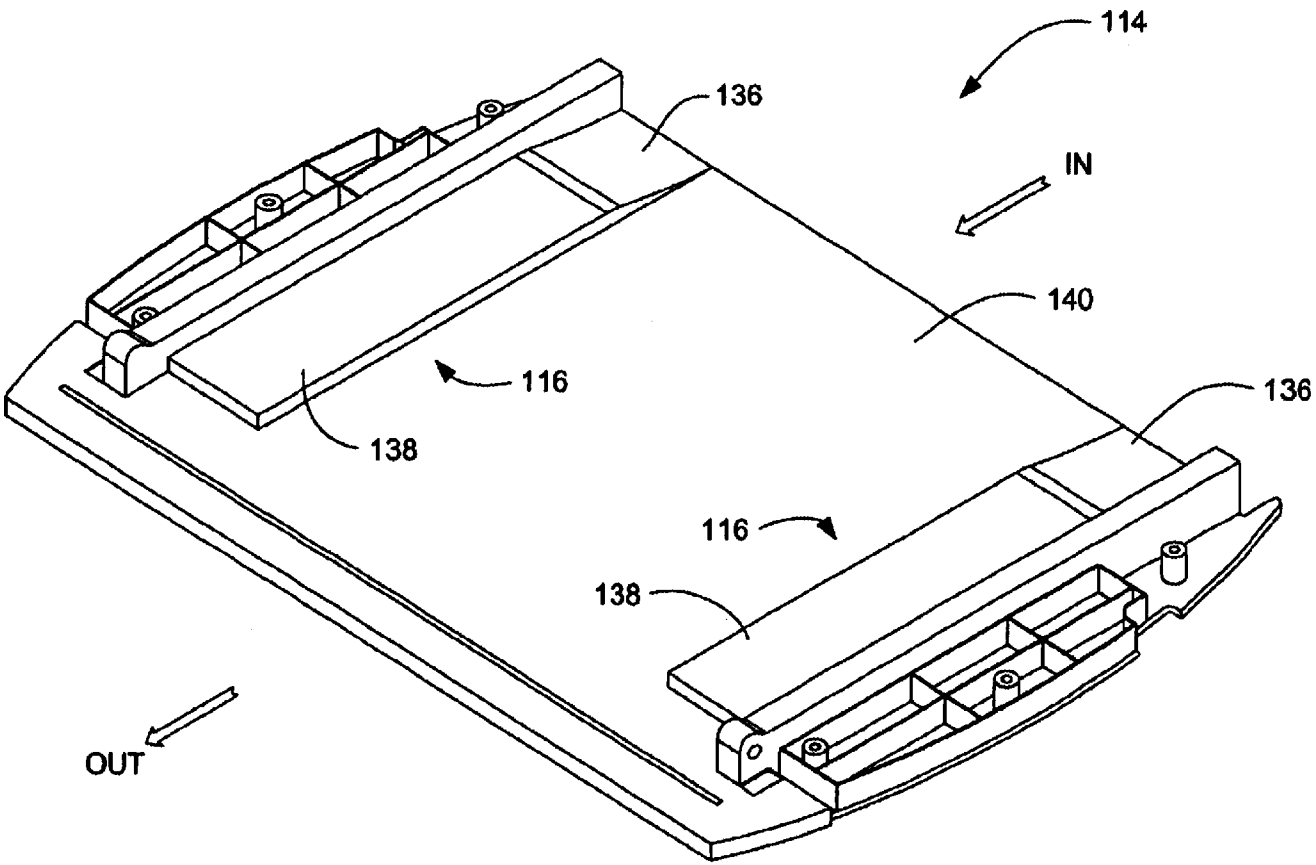
FIG. 5 is a perspective view of an embodiment of the base.

Referring now to FIG. 5, the base 114 is adapted to accommodate two separate sheets of vacuum bag material simultaneously. The base 114 has two raised side tracks 116 and a floor 140. Each raised side track 116 consists of a ramp 136 and a flat surface 138. When a large roll of vacuum bag material enters the base 114 the side edges of the vacuum bag material will first contact the ramp 136. The ramp 136 is sloped, starting at the level of the floor 140 and rising upward to the height of the flat surface 138. As the vacuum bag material travels toward the "OUT" of the base 114, the material slides up the ramp 136, onto the flat surface 138 and continues across the flat portion 138. The vacuum bag material from the large roll will thus travel out of the base 114 along the flat surface 138. By way of example only, the flat surface 138 is typically ¼"–½" high.

A small roll of vacuum bag material can simultaneously travel through the base 114. The two raised tracks 116 are spaced far enough apart so that side edges of a small roll of vacuum bag material will not travel along the tracks 116. Instead, the material will travel along the floor 140 of the base 114. Thus, a large roll of vacuum bag material will exit the base 114 above a small roll of vacuum bag material, allowing a user to individually access either the large roll or the small roll of vacuum bag material independently.

Figure 6:
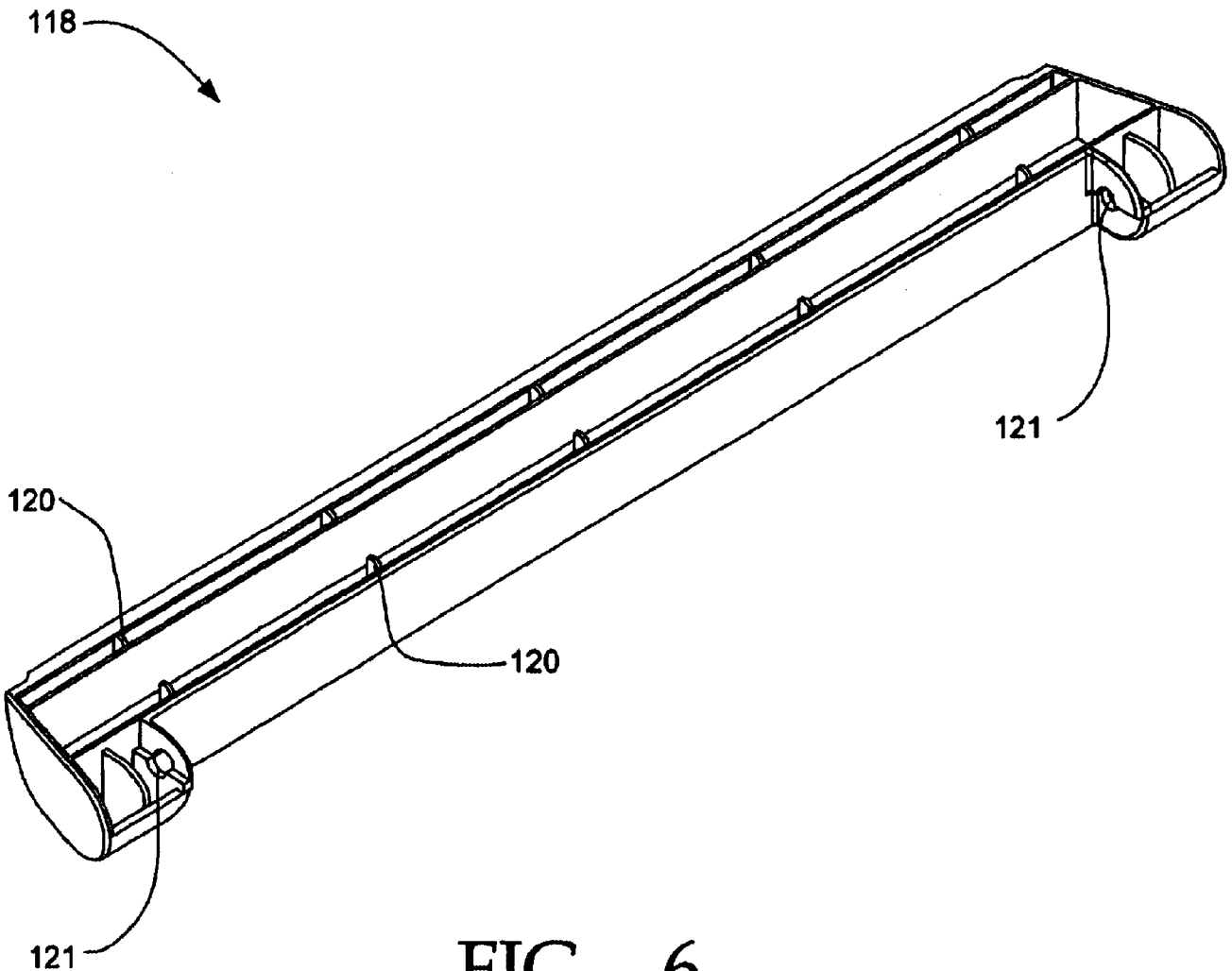
FIG. 6 is a perspective view of the under side of an embodiment of cover for the bag material as depicted in FIG. 1.

Referring now to FIG. 6, the underside of the cover 118 has feet 120. To prevent the vacuum bag material from slipping during cutting, the feet 120 engage the base when the cover 118 is closed. The feet 120 are preferably round so that the feet 120 do not puncture the bag material when the cover 118 is placed over, and pressed upon the bag material during cutting. As shown in FIG. 6, there are fifteen feet 120. It is within the scope of the present invention for the cover 118 to have more or less than fifteen feet 120, as long as the feet 120 hold the bag material in place during cutting.

To create an individual sheet from either the large or small roll of vacuum bag material the user must first pull out the material from the front end of the base 114. By lifting the cover 118, the material can be pulled out of the base 114 to the desired length of the individual bag he/she intends to create. The user then places the cover 118 back down onto the material. The cover 118 has feet 120 along the underside. While pressing on the cover 118, the feet 120 contact the sheet of material and secure the material on both sides of slot 122. The feet 120 ensure that the material will not slip while it is being cut by the cutting mechanism 123.

The cutting mechanism 123 slides across the material within the slot 122. The cutting mechanism 123 comprises a blade 124 which is attached to a handle 126. While holding the cover 118 down, the user may slide the handle 126 across the slot 122, cutting the sheet of material with the blade 124 and creating an individual sheet. The blade 124, guided by the slot 122, creates an individual sheet with a straight edge. After the first cut across the sheet of material is made the user can then lift the cover 118 to remove the sheet of material. Now that an individual sheet of vacuum bag material has been created the user can form an individual bag. By following the directions of the food packaging system. By way of example only, one end of the sheet can be placed across the wire of the vacuum packaging apparatus to melt the layers together and form a first end. With one end sealed, food can be placed within the bag and subsequently vacuum sealed for storage.

Preferably, the bag stand 100 is easy to assemble. By way of example only, a user can assemble the bag stand 100 by completing the following steps. First, place the base 114 on a flat surface and snap the storage unit 104 into the base 114. Then, snap the rear cover 106 into the storage unit 104. Next, open the rear cover 106 and place the first and second rollers 108, 110, with a roll of vacuum bag material around each spindle, into the "U"-shaped notches 113. The user can then thread both rolls of vacuum bag material from the storage unit through the base 114 so that when the cover 118 is lifted the material can be processed. With the bag stand 100 assembled to create individual pouches of vacuum bag material, the user can place their existing vacuum sealing apparatus onto the platform 102. The combination of the bag stand 100 and the vacuum sealing apparatus will allow the user to create and vacuum seal individual bags.

The foregoing description of preferred embodiments of the present invention has been provided for the purposes of illustration and description. It is not intended to be exhaustive or to limit the invention to precise forms disclosed. Embodiments were chosen and described in order to best explain the principles of the invention and its practical application, thereby enabling others skilled in the art to understand the invention and various embodiments with various modifications that are suited to a particular use contemplated. It is intended that the scope of the invention to be defined by the following claims and their equivalents.

What is claimed is:

1. A device to assist in the creation of vacuum bags, the device comprising:

a platform with a proximal end and a distal end adapted to support a vacuum bag sealing apparatus;

a storage unit connected with and extending above the platform from said distal end, having a first roller, said roller adapted to accommodate a roll of vacuum bag material;

a base supporting the platform having an inlet and an outlet, and adapted to accommodate a feed of vacuum bag material with the outlet located adjacent to said proximal end of said platform;

a slidable cutting mechanism adapted to cut the vacuum bag material, said slidable cutting mechanism located adjacent to said proximal end of said platform;

wherein the vacuum bag sealing apparatus is supported on the platform between said storage unit and said slidable cutting mechanism;

wherein the slidable cutting mechanism includes a cover having feet to hold the vacuum bag material in place while the vacuum bag material is being cut.

2. A device to assist in the creation of vacuum bags, the device comprising:

a platform with a proximal end and a distal end adapted to support a vacuum bag sealing apparatus;

a storage unit connected with and extending above the platform from said distal end, having a first roller, said roller adapted to accommodate a roll of vacuum bag material;

a base supporting the platform, having an inlet and an outlet, and adapted to accommodate a feed of vacuum bag material with the outlet located adjacent to said proximal end of said platform;

a cutting mechanism adapted to cut the vacuum bag material, said cutting mechanism located adjacent to said proximal end of said platform;

wherein a portion of the platform that supports the vacuum bag sealing apparatus has a width at least twice as large as a width of a portion of the platform that supports the storage unit; and wherein the cutting mechanism includes a cover having feet to hold the vacuum bag material in place while the vacuum bag material is being cut.

3. A device to store material and create individual sheets, the device comprising:

a platform with a proximal end and a distal end;

a storage unit connected with and extending above the platform from said distal end, having a first and second roller, each roller adapted to accommodate a roll of material;

a base supporting the platform, having an inlet and an outlet, and adapted to accommodate two feeds of material with the outlet located adjacent to said proximal end of said platform;

a slidable cutting mechanism adapted to cut the material, said slidable cutting mechanism located adjacent to said proximal end of said platform;

wherein a bag sealing apparatus can be supported on the platform between said storage unit and said slidable cutting mechanism; and wherein the slidable cutting mechanism includes a cover having feet to hold the material in place while the material is being cut.

4. A device to assist in the creation of individual bags, the device comprising:

a platform with a proximal end and a distal end adapted to support a bag sealing apparatus;

a storage unit connected with and extending above the platform from said distal end, having a first roller, said roller adapted to accommodate a roll of bag material;

a base supporting the platform, having an inlet and an outlet, and adapted to accommodate a feed of bag material with the outlet located adjacent to said proximal end of said platform;

a cutting mechanism adapted to cut the bag material, said cutting mechanism located adjacent to said proximal end of said platform;

wherein the bag sealing apparatus is supported on the platform between said storage unit and said cutting mechanism; and wherein the cutting mechanism includes a cover having feet to hold the bag material in place while the bag material is being cut.

5. A device to assist in the creation of individual vacuum bags, the device comprising:

a platform adapted to support a vacuum bag sealing apparatus;

a storage unit attached with the platform, having a first roller, said roller adapted to accommodate a roll of vacuum bag material;

a base connected with the platform, having an inlet and an outlet, and adapted to accommodate a feed of vacuum bag material; and a cutting mechanism adapted to cut the vacuum bag material, said cutting mechanism having a cover with feet to hold the vacuum bag material in place while the vacuum bag material is being cut;

wherein the bag sealing apparatus is supported above the base.

6. A device to assist in the creation of vacuum bags, the device comprising:

a platform with a proximal end and a distal end adapted to support a vacuum bag sealing apparatus;

a storage unit connected with and extending above the platform from said distal end, having a first and second roller, each roller adapted to support a roll of vacuum bag material;

a base supporting the platform having an inlet and an outlet, adapted to accommodate two feeds of vacuum bag material with the outlet located adjacent to said proximal end of said platform, each feed stored at a different height so that a user can access either feed from the outlet of the base; and a slidable cutting mechanism adapted to cut the vacuum bag material, said slidable cutting mechanism located adjacent to said proximal end of said platform;

wherein the vacuum bag sealing apparatus is supported on the platform between said storage unit and said slidable cutting mechanism.

7. The device as recited in claim 6, wherein the slidable cutting mechanism includes a cover having feet to hold the vacuum bag material in place while the vacuum bag material is being cut.

8. A device to assist in the creation of vacuum bags, the device comprising:

a platform with a proximal end and a distal end adapted to support a vacuum bag sealing apparatus;

a storage unit connected with and extending above the platform from said distal end, having a first and second roller, each roller adapted to support and self-align a roll of vacuum bag material;

a base supporting the platform having an inlet and an outlet, adapted to support two feeds of vacuum bag material so that a user can access either feed from the outlet of the base; and a slidable cutting mechanism adapted to cut the vacuum bag material said slidable cutting mechanism located adjacent to said proximal end of said platform;

wherein the vacuum bag sealing apparatus is supported on the platform between said storage unit and said slidable cutting mechanism.

9. The device as recited in claim 8, wherein the cutting mechanism includes a cover having feet to hold the vacuum bag material in place while the vacuum bag material is being cut.

10. A device to store material and create individual sheets, the device comprising:

a platform;

a storage unit attached with the platform, having a first and second roller, each roller adapted to support a roll of material;

a base supporting the platform having an inlet and an outlet, adapted to support two sheets of material, each sheet stored at a different height so that a user can access either sheet from the outlet of the base; and a slidable cutting mechanism attached with the base, adapted for cutting the material;

wherein a bag sealing apparatus can be supported on the platform between said storage unit and said slidable cutting mechanism.

11. The device as recited in claim 10, wherein the slidable cutting mechanism includes a cover having feet to hold the material in place while the material is being cut.

12. A device to assist in the creation of vacuum bags, the device comprising:

a storage wilt having a first roller and a second roller, each roller adapted to selectably store a small or large roll of vacuum bag material;

a base having an inlet and an outlet, and further having two levels, adapted to allow the small and large roll of vacuum bag material to pass simultaneously through the base;

a cutting mechanism having means for creating apiece from the vacuum bag material;

a platform to support a vacuum bag sealing apparatus above the base;

wherein a user may access both the small roll or the large roll of vacuum bag material from the outlet of the base; and wherein the small roll has a width narrower than that of the large roll.

13. The device as recited in claim 12, wherein at least one of the first and second roller can include a tapered portion such that when the small roll of vacuum bag material is connected with the first or second roller, the small roll will self align so that the small roll is centered with respect to the roller.

14. The device as recited in claim 12, wherein the cutting mechanism includes a cover having feet to hold the vacuum bag material in place while the vacuum bag material is being cut.

15. The stand of claim 14 including
a cutting mechanism located adjacent to the outlet.

* * * * *